US008070161B2

(12) United States Patent
Ward

(10) Patent No.: US 8,070,161 B2
(45) Date of Patent: Dec. 6, 2011

(54) GAME BALLS BEARING MULTIPLE GAME INDICIA AND GAMES PLAYED THEREWITH

(76) Inventor: Bradley G. Ward, Henderson, NV (US)

( * ) Notice: Subject to any disclaimer, the term of this patent is extended or adjusted under 35 U.S.C. 154(b) by 0 days.

(21) Appl. No.: 12/661,159

(22) Filed: Mar. 10, 2010

(65) Prior Publication Data

US 2010/0230896 A1 Sep. 16, 2010

Related U.S. Application Data

(60) Provisional application No. 61/210,006, filed on Mar. 13, 2009.

(51) Int. Cl.
*A63F 3/06* (2006.01)

(52) U.S. Cl. ..... 273/269; 273/138.1; 273/288; D21/369; D21/386

(58) Field of Classification Search ..... 273/269, 273/144 R, 144 A, 144 B, 138.1, 288; D21/369, D21/386

See application file for complete search history.

(56) References Cited

U.S. PATENT DOCUMENTS

| | | | | |
|---|---|---|---|---|
| 4,015,850 | A * | 4/1977 | Russell | 273/269 |
| 2003/0168802 | A1 * | 9/2003 | Hsu et al. | 273/139 |
| 2004/0121834 | A1 * | 6/2004 | Libby et al. | 463/19 |

* cited by examiner

*Primary Examiner* — Benjamin Layno
(74) *Attorney, Agent, or Firm* — Weide & Miller, Ltd.

(57) ABSTRACT

A game ball has two different game indicia associated therewith. One or more of such game balls may be part of a set of game balls, such as a set of balls used to play a bingo, keno or lottery game where the game indicia may comprise numbers used to play lottery or keno, or combinations of letters and numbers for play of a bingo game. Compared to game balls bearing a single game indicia, selection of a game ball bearing multiple game indicia presents a player with an increased or bonus matching opportunity. The game balls may be physical elements or be electronic representations, such as displayed images, thereof.

9 Claims, 2 Drawing Sheets

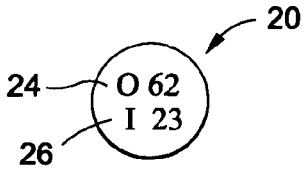
FIG. 1
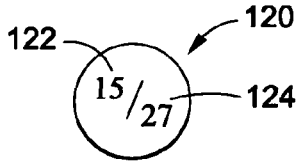
FIG. 2
| B | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| I | 16 | 17 | 18 | 19 | 20 | 21 | 22 | 23 | 24 | 25 | 26 | 27 | 28 | 29 | 30 |
| N | 31 | 32 | 33 | 34 | 35 | 36 | 37 | 38 | 39 | 40 | 41 | 42 | 43 | 44 | 45 |
| G | 46 | 47 | 48 | 49 | 50 | 51 | 52 | 53 | 54 | 55 | 56 | 57 | 58 | 59 | 60 |
| O | 61 | 62 | 63 | 64 | 65 | 66 | 67 | 68 | 69 | 70 | 71 | 72 | 73 | 74 | 75 |
FIG. 3
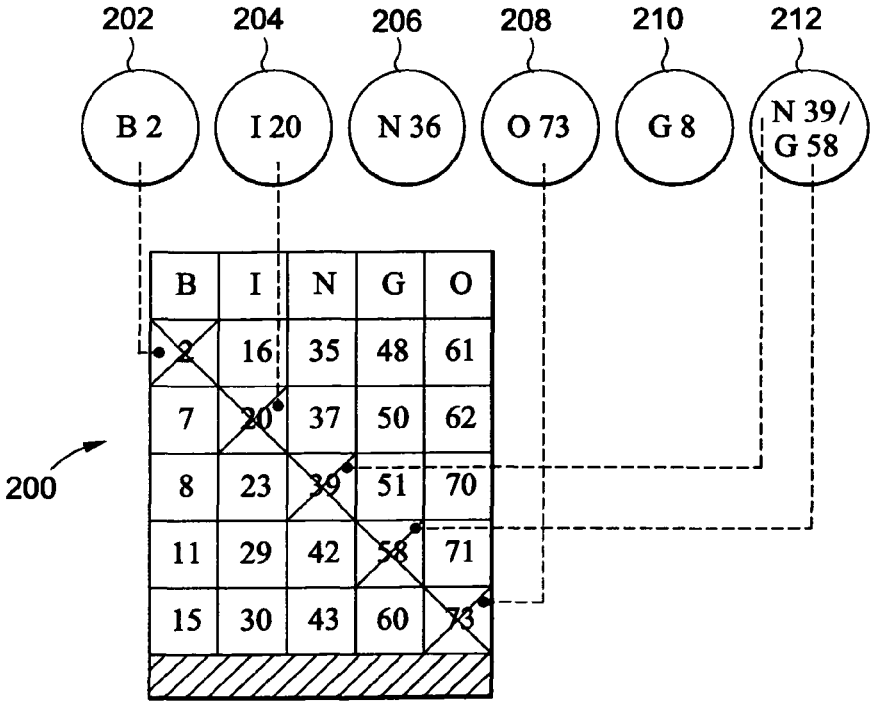
FIG. 4

GAME BALLS BEARING MULTIPLE GAME INDICIA AND GAMES PLAYED THEREWITH

RELATED APPLICATION DATA

This application claims priority to U.S. Provisional Patent Application Ser. No. 61/210,006, filed Mar. 13, 2009.

FIELD OF THE INVENTION

The present invention relates to game balls and games played therewith, and particularly to game balls which bear two or more game indicia.

BACKGROUND OF THE INVENTION

Bingo and similar "matching" games, such as keno and lottery games, are very popular. The game of bingo is played with a set of game indicia. The game indicia may comprise letters, numbers, or a combination thereof. Players are issued cards having a plurality of spaces which are marked with game indicia or other indicators (such as a "free" space). The total number of spaces of the game card, and thus the number of game indicia associated with the card, is less than the entire set of game indicia. Players attempt to match the game indicia associated with the spaces of their card(s) with game indicia associated with game balls. In particular, a set of game balls is provided, each game ball configured to display a single game indicia. In this manner, the entire set of game balls is equal to the number of game indicia.

In the play of the game, physical balls (or electronic representations thereof) are selected. The player attempts to match the single game indicia indicated on each selected game ball to the game indicia displayed on their card. The player's goal is to achieve matches on their card in predetermined patterns or combinations in order to receive a winning outcome.

As indicated, however, in a bingo game, each bingo ball is marked with a single one of the game indicia. The balls are called or selected, generally one at a time (in some cases, a first group of balls may be selected to start the game, where after balls are selected one at a time until a winner is achieved). As each ball is selected or generated, each player determines if the single game indicia associated with that game ball matches any of the game indicia associated with their card. One problem with the game of bingo played in this manner is that it is generally very slow. In addition, there are few winners of the game because the game is typically terminated as soon as a ball is selected or generated which causes a player or players to receive a game-ending pattern.

SUMMARY OF THE INVENTION

One aspect of the invention comprises one or more game balls bearing two or more game indicia. Other aspects of the invention comprise sets of game balls which include at least one game ball bearing two or more game indicia, and presentation and play of games using such game balls.

In one embodiment, at least one game ball has two or more game indicia associated therewith. The two or more game indicia are preferably different from each other and selected from a set of game indicia used to play a game. The game ball(s) may comprise a physical ball or an electronic representation thereof. Further, the game ball(s) may be spherical or have other shapes.

Another embodiment of the invention comprises a set of game balls having game indicia associated therewith. Preferably, the game balls represent at least one occurrence of each of a set of game indicia. In one embodiment, at least one of the game balls of the set has two or more game indicia associated therewith.

In a preferred embodiment of the invention, a game ball comprises a bingo ball and a set of game balls comprises a set of bingo balls. The game balls have bingo numbers (letters and/or numbers and/or codes) associated therewith. At least one occurrence of each bingo number used in the play of a bingo game is associated with one of the game balls. Preferably, at least one of the game balls displays two or more of the bingo numbers.

Other aspects of the invention comprise methods of presenting and playing games using one or more game balls in accordance with the invention. In one embodiment, a game of bingo is played using a set of bingo balls. The set of bingo balls includes one or more bingo balls displaying one bingo number, and at least one bingo ball displaying at least two bingo numbers. In the play of the game, players attempt to match bingo numbers on their game card(s) with those displayed by selected bingo balls. Relative to the one or more bingo balls bearing two or more bingo numbers, the player has the opportunity to match up to two or more bingo numbers to their card based upon the single selected bingo ball.

Other aspects of the invention comprise lottery, keno and other games played with game balls in accordance with the invention.

Further objects, features, and advantages of the present invention over the prior art will become apparent from the detailed description of the drawings which follows, when considered with the attached figures.

DESCRIPTION OF THE DRAWINGS

FIG. 1 illustrates a game ball in accordance with one embodiment of the invention;

FIG. 2 illustrates a game ball in accordance with another embodiment of the invention;

FIG. 3 illustrates a possible set of game indicia used to play a game;

FIG. 4 illustrates a game card bearing game indicia and game balls bearing game indicia for matching to the game indicia associated with the game card.

DETAILED DESCRIPTION OF THE INVENTION

Figure 5:
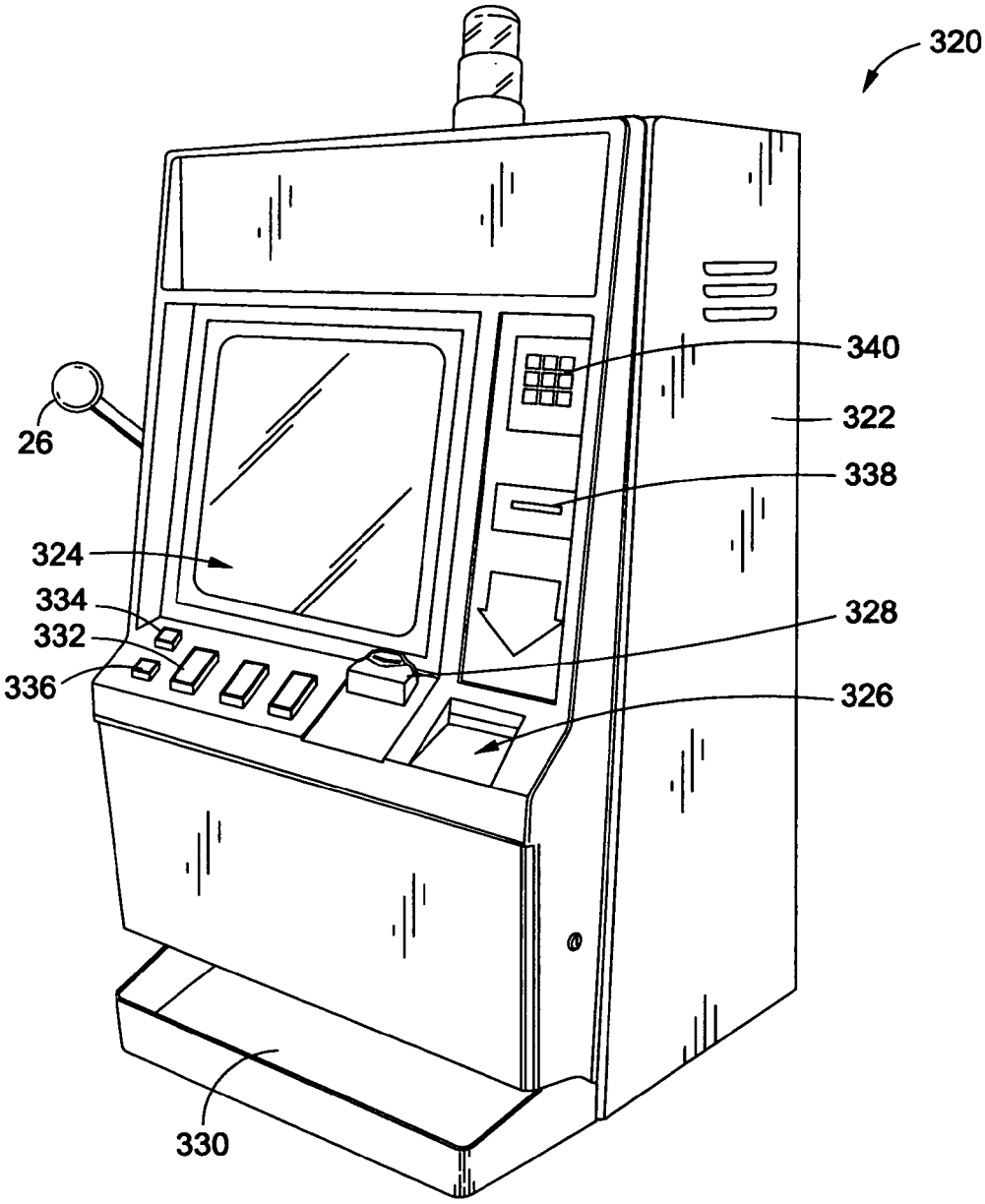
FIG. 5 illustrates a gaming machine at which a game in accordance with the invention may be presented.

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One aspect of the invention comprises one or more game balls marked or displaying or otherwise having two or more different game indicia associated therewith. Other aspects of the invention comprise a set of game balls. Yet another aspect of the invention comprises methods of presenting and playing games using such game balls.

FIG. 1 illustrates a game ball 20 marked with, bearing or displaying at least a first game indicia 24 and a second game indicia 26. The game indicia may comprise one or more letters, numbers, symbols, or combinations thereof. For example, relative to the game of bingo, each game indicia may comprise the combination of a letter and a number. In the example illustrated, the first game indicia 24 comprise the designation "O62", while the second game indicia 26 comprises the designation "I23". Preferably, the at least two game indicia are, as detailed below, selected from a set of game indicia used to play a game.

The game ball 20 may be a physical ball, such as a wooden or plastic ball. The game indicia may be associated with the ball in various fashions, such as by printing, embossing or the like. It is also possible to associate game indicia with the game ball in other manners, such as via coding (for example, bar codes, RFID tags or the like might be linked or correspond to one or more game indicia, whereby the indicia themselves are not actually directly displayed on the ball(s)) or the like. While the game ball 20 may be spherical in shape, it might have other shapes or forms, such as a cube or the like. In this regard, the game ball could comprise a token or other element. The game ball 20 may be constructed from various materials.

In other embodiments, the game ball 20 may be virtual, such as in the form of an electronically generated image or representation or other data. For example, the game ball 20 may comprise a two or three dimensional image which is displayed by one or more electronic displays.

Preferably, the game ball 20 has at least two game indicia associated therewith. However, it might display three or more game indicia. It is also possible for the game ball 20 to have two or more duplicate sets of the game indicia associated therewith. For example, relative to the game ball 20 illustrated in FIG. 1, a first set of the first and second game indicia 24,26 may be displayed on a front of the game ball 20 and a duplicate set of the first and second game indicia 24,26 might also be duplicated on a rear of the game ball. In this manner, the multiple game indicia may be more readily viewable/readable.

FIG. 2 illustrates another embodiment of a game ball 120 marked with a first game indicia 122 and a second game indicia 124. In this embodiment, the game indicia comprise numbers alone. As indicated, the game indicia may have various forms, such as depending upon a particular game to be played using the game ball(s).

The game ball may include other markings and include other elements. For example, the game balls or the game indicia might include a color attribute.

Preferably, the game indicia associated with the game ball have significance to a game, such as to one or more game cards used to play a game. The game indicia may be used in a matching game, such as in the game of bingo. One example of a game using a game ball in accordance with the invention will be described with reference to FIGS. 3 and 4. In one embodiment, a game of bingo may be played with a set of seventy-five (75) game indicia comprising combinations of the letters B-I-N-G-O with the numbers 1-75. As illustrated in FIG. 3, the numbers 1-15 may be associated with the letter B; the numbers 16-30 may be associated with the letter I; and so on.

In one embodiment, physical or electronically represented game cards bear game indicia. In one embodiment, as illustrated in FIG. 4, a game card 200 may have a plurality of game spaces. The game spaces may each bear at least one game indicia (though one or more of the spaces might disclose other elements, such as a "free" space or the like, as is known in the game of bingo). As illustrated, the game card 200 may be configured so that five numbers are associated with the letter "B"; five numbers may be associated with the letter "I"; and so on; for a total of twenty-five (25) spaces and associated game indicia. The game indicia are preferably randomly selected from the possible set of game indicia indicated in FIG. 3.

During the game, game balls 20 are selected and the game indicia associated with those balls are compared or matched to those on the bingo game card. In one embodiment of a game, all game balls may bear at least two game indicia. In a preferred embodiment, however, one or more, but not all, game balls are marked with two or more indicia. The remaining game balls may be marked with only a single game indicia, or there might be duplicates of the game balls marked with two or more indicia.

Thus, relative to the illustrated example, a first bingo ball 202 may be selected or generated. As illustrated, this first bingo ball 202 has the single associated game indicia "B2". The player determines if this game indicia matches any of the game indicia associated with their card. In this example, that game indicia does match and the match is so indicated on the card. In one embodiment, an object of the game is for a player to achieve a particular pattern or number of game indicia matches. These one or more patterns may comprise winning outcomes. One or more patterns may comprise "interim" patterns in that they comprise winning outcomes but do not end the game. One or more patterns may comprise a "game ending" pattern which ends the game.

Various prizes or the like may be awarded for game winning outcomes. The prizes may comprise goods, services, points or money or representations thereof, or other types of awards, such as recognition. For example, when the game is played as a wagering game, the prizes may comprise monetary awards. The particular prizes for the various outcomes may vary, such as in accordance with a pay table. In other embodiments, awards may change in value, such as in the form of a jackpot or progressive jackpot, mystery prize or the like. Also, awards may be divided among multiple players or vary based upon the size of wager, type of game card being played or other criteria.

In the example illustrated, successive game balls 204, 206, 208, 210 and 212 have been called. Several of these game balls have game indicia which match game indicia on the player's card, while other game balls have game indicia which do not match any game indicia associated with the player's card.

As illustrated, the final game ball 212 was marked with two game indicia, namely the game indicia "N39" and "G58". These two game indicia matched game indicia associated with the player's card 200, and formed a game winning "diagonal" pattern of matches. The player may thus be paid winnings or awarded other awards for such a game result (e.g. a "bingo").

Use of game balls bearing multiple game indicia has numerous advantages. One advantage is that game outcomes which would not otherwise be realized may be achieved. For example, relative to the game example described with reference to FIG. 4, the player might not have received a winning outcome if the last game ball 212 which was called were not marked with two game indicia. As indicated, in this example, the last game ball 212 which was called allowed the player to receive two matches, thus resulting in a game winning outcome. If the last game ball 212 which was called had only one game indicia associated therewith, the player would not have achieved a winning outcome at the point that the game ball 212 was selected. However, another player might have achieved a winning outcome in that event, and the game might have ended before any subsequent balls were drawn. Thus in accordance with one aspect of the invention, use of one or more game balls bearing at least two game indicia may result in additional winning outcomes that would never be achieved by playing a game using game balls bearing only a single game indicia.

It will also be appreciated that games played using game balls in accordance with the invention may move more quickly. In particular, because multiple matches may be achieved with respect to one or more game balls, winning outcomes may be achieved more quickly than if the game balls each bear only a single game indicia. Games played using such game balls may also result in more game winners and, in games such as bingo, less consolation prizes (and more game winners).

Of course, game balls in accordance with the invention may be used to play other games, such as keno type games, lottery games, sweepstakes, raffles or a variety of other games or promotions where game indicia are utilized. For example, in a game of lottery, a player is assigned player numbers (the numbers might be selected by the player or they might be selected randomly by a computer or the like). The player's numbers may be associated with a lottery ticket, such as by printing them on the ticket. The player attempts to match numbers called or selected during play of the game to their player numbers. In one embodiment, a player may attempt to match six (6) player numbers. The game numbers may be associated with game balls. In one embodiment, six (6) game balls may be selected. One or more of those game balls may be marked with two or more game numbers, however, thus increasing the probability that a player may match their six (6) player numbers to the numbers associated with the six (6) game balls.

As indicated, in accordance with the invention a game ball is marked with two or more game indicia. Preferably, these indicia are different and are selected from the possible set of game indicia used to play a game. For example, if the game is a bingo game utilizing the game indicia B1, B2, etc. through O75, as illustrated in FIG. 4, then the two or more different indicia associated with the game ball preferably comprise two or more different of these possible game indicia, and less than all of the game indicia of the set. Further, preferably those two or more game indicia are capable of being matched to or correspond to two or more different game indicia used to play the game, such as up to two game indicia associated with a player's card.

The number of game balls which bear two or more game indicia may vary. For example, in a traditional game of bingo using game indicia B1 to O75 as illustrated in FIG. 3, the game would typically be played with 75 game balls, each game ball bearing a single unique one of the game indicia. However, in accordance with the invention, one or more of the game balls may have two or more game indicia associated therewith. In one embodiment, one or more of the indicia may appear on or be associated with two or more of the game balls. For example, relative to FIGS. 4 and 5, individual game balls may be provided which are marked with the game indicia "N39" and "G58", as well as a game ball which is marked with both of those game indicia. In a preferred embodiment, however, game balls bear unique sets of game indicia such that no indicia appear more than once. Thus, in a preferred embodiment, one game ball bears the game indicia "N39" and "G58" and no other game ball bears either of those game indicia (such that if that were the only game ball bearing multiple game indicia, there would be seventy-four (74) game balls in this example). Of course, there might be multiple game balls which bear two or more game indicia.

In this regard, one aspect of the invention is a set of game balls. Preferably, each game ball has at least one game indicia associated therewith. Most preferably, one or more of the game balls have two or more different game indicia associated therewith. The set of game balls may be selected so that they include at least one occurrence of each of the game indicia of a set of game indicia used in the play of a game.

Further, the particular game indicia born by a game ball may vary, such as from game to game. For example, in one game a set of game balls might be used where one of the balls bears the two game indicia "N39" and "O58". However, in a subsequent game, a different set of game balls might be used, and that set might include game ball which bears different multiple game indicia. For example, in the second game, the set of balls might include a game ball bearing the indicia "B4" and "O68" (rather than "N39" and "G58"). This configuration of the invention is easily implemented in an electronic environment in which the game balls are electronically generated and displayed. However, this configuration could also be implemented with physical balls, where different balls or sets of balls are provided for various games.

As indicated, various aspects of the invention may be implemented in physical or electronic formats. For example, a bingo game in accordance with the invention may be played with physical balls and cards. The games might also be played via electronic game devices, or via combinations of physical balls/cards and such devices.

For example, the invention may be implemented via one or more gaming machines 320, such as illustrated in FIG. 5. As illustrated, the gaming machine 320 includes a housing 322 for enclosing/supporting various components of the gaming machine. The housing 322 have a variety of configurations. In one embodiment, the housing 322 is configured to the gaming machine has an "upright" configuration. The machine 320 might also be configured as a "slant"-type, "bar-top" or have other forms (the machine might comprise a kiosk, hand-held or mobile device, a computing device, a display device associated with a network environment or many other devices configured to present game information, including televisions, theatre screens and others).

In one embodiment, the gaming machine 320 is configured as a "video" type gaming machine, the machine including at least one display 324 for displaying game information to a player (the display might comprise a main game display or secondary or side screen of such a gaming machine as well). As described below, this game information may include images of game balls and an image of a player card bearing game indicia.

The gaming machine 320 may include other means for providing information to a player. For example, speakers (not shown) or other devices may be provided for generating sound associated with the game. The gaming machine 320 may also include lights, printed instructions and other displays/display devices.

In one embodiment, a player must make payment in order to be entitled to play the game. Preferably, the game is presented as a wagering type game, and a player must place a bet or wager in order to play the game for the opportunity to receive winnings. Preferably, if the player is a winner of the game, the player is provided an award, such as a monetary payout (such as coins), credits representing monetary value, points or tangible prizes. As illustrated, the gaming machine 320 may include a bill validator/acceptor 326 for accepting paper currency and a coin acceptor 328 for accepting coins. Other means of payment, such as a credit card reader, electronic funds transaction devices and the like, may be provided. An award of winnings in the form of coins may be paid to the player via a coin tray 330.

Preferably, the gaming machine 320 includes means for a player to provide input. In one embodiment, this means comprises one or more buttons. For example, a plurality of reel "spin" or "select" buttons 332 may be provided for permitting a player to provide game input. A bet one button 334 and bet max button 336 are provided for a player to select the amount to bet on a particular game. Other means of input may be provided, such as a touch-screen display and other devices now known or later developed.

A game controller (not shown) is provided for controlling the various devices of the gaming machine and for providing game information. For example, the game controller may be arranged to generate video and/or audio data for presentation by the display and speakers of the gaming machine 320. The game controller may be arranged to detect a signal from the coin acceptor indicating the receipt of coins or a signal from the bill validator regarding accepted bills and for registering credits corresponding to those inputs, for subtracting credits for wagers placed by a player, and for causing a coin delivery mechanism to deliver coins from a coin hopper to the coin tray 330 for payment of winnings and/or return to a player of unwagered credits. Preferably, the one or more player input devices provide an output to the gaming controller for use in play of the game. For example, in response to a "bet one" input by a player, the gaming controller is preferably transmitted a signal which causes the gaming controller to initiate presentation of the game.

It will be appreciated that the gaming machine 320 may have a variety of configurations, and that the gaming machine 320 illustrated and described above is but an example of a device for implementing the game of the present invention. For example, in one or more embodiments, the gaming machine 320 may be associated with a network and receive game information remotely and may transmit information, such as payout and game play information, to/from a remote location. For example, a remote master controller may generate game information which is transmitted over a communication link to/from the gaming machine 320. That information may be utilized by a local controller or processor to present the game, such as by displaying game play data or information.

As indicated, in one embodiment, game information is displayed by a video display 324 to a player. That display may be of a variety of types, including CRT, LCD, plasma and others. The gaming machine 320 may also include more than one video display.

In another embodiment, the gaming machine 320 may include one or more physical reels capable of displaying symbols. In such a configuration, means are provided for rotating the physical reels. In one or more embodiments, the means may comprise a mechanical linkage associated with a spin arm, with movement of the spin arm (a "pull") by a user causing the reels to spin. In such an arrangement, the reels are generally allowed to free-wheel and then stop. In another embodiment, electronically controlled mechanisms are arranged to rotate and stop each reel. Such mechanisms are well known to those of skill in the art. In this arrangement, actuation of the spin arm or depression a spin button causes a controller (not shown) to signal the activation of the spin mechanism associated with one or more of the reels. Preferably, the controller is arranged to either turn off the signal to the device(s) effecting the rotation of each or all of the reels or generates a signal for activating a braking device, whereby the reels are stopped. As is well known, the combinations of reel positions and their odds of hitting are associated with the controller, and the controller is arranged to stop the reels in a position displaying a combination of indicia as determined by the controller based on the combinations and odds. The principal of such an arrangement is described in U.S. Pat. No. 4,448,419 to Telnaes, which is incorporated herein by reference.

The gaming machine 320 may have other configurations, including other features. For example, the gaming machine 320 may include a player tracking device, such as a card reader 338 and associated keypad 340. Such player tracking devices are well known and may permit the game operator to track play of players of the gaming machine. The tracked play may be utilized to offer player bonuses or awards. Such a device might include a display, such as a dollar-bill sized or similar small display.

In one embodiment, the gaming machine 320 may be configured to dispense media, such as printed paper tickets, which have associated value. For example, winnings or unused credits may be returned to the player via a printed ticket having value or associated value. In one embodiment, the gaming machine 320 might also be configured to accept such media for providing credit for game play. Such systems are well known and thus not described in detail herein.

In one embodiment, the games of the invention are played as wagering type games in which a player must place a wager in order to play the game for an opportunity of winnings. In other embodiments, the game may be played for fun or prizes. In such event, the player may be permitted to play the game for free or may be required to make payment to play the game.

As indicated above, a player may provide value to the gaming machine 320 or machine operator in a number of ways, including with coins or bills. The player might also be permitted to provide value remotely. Value provided to the gaming machine 320 may be represented as credits. Each credit may have an associated monetary or point value.

Once the player provides value, the player preferably places a wager to play the game. This may be accomplished, in one embodiment, by the player pressing the "bet one" button 334 or the "bet max" button 336, or by other means.

As indicated, in one or more embodiments, the gaming machine 320 may be a stand-alone unit. In other embodiments, however, the gaming machine 320 may be associated with other machines or other devices such as a central host or server. For example, in a bingo game, individual players may play different gaming machines 320. A central server or host may generate game cards and information regarding selected game balls. Each player's game card(s) may be displayed to them at their respective gaming machine 320. Similarly, game balls used to play the game may be displayed to all of the players.

It will be appreciated that the various games and gaming machines of the invention may vary, such as depending on the laws or regulations of the jurisdiction where the game or gaming machine is operated. For example, in certain jurisdictions a bingo game may not be started until at least two players (including players of gaming machines) have entered the game, while in other jurisdictions the game might start with but a single player.

The games of the invention might also be presented with combinations of devices. For example, gaming machines might display game cards to players. Physical game balls might be selected via a blower device and the associated game indicia might be called out to the players. Those players may then designate game card matches or such matches might be automatically indicated. Further, game card matches might be designated physically, such as by marking, or automatically, such as via an electronic device. The player may be required to provide an input, however, to mark or "daub" matches. In electronic gaming machine and other environment, one or more random number generators may be utilized to randomly generate numbers which designate or "select" game balls (for example, numbers may be coded to game balls, such that a generated random number designates a particular game ball, which game ball may then be displayed on an electronic display).

It will be appreciated that sets of game balls may include any number of game balls. As indicated above, the numbers 1-75 are widely used in the game of bingo. Depending upon the number of game balls which have two or more indicia associated therewith, there might be as few as two (2) balls (such as where two balls are marked with numerous indicia), or as many as one hundred fifty (150) or more (such as where pairs of game balls bear a common set of two of the game indicia such as B1/O75 and O75/B1). Of course, in other games, numbers from 1-20, 1-80, 1-90 and the like may be used, in which case the number of game balls may vary.

In one embodiment, aspects of the invention may be implemented as a "main" game or as a bonus game or event, side game or the like. For example, game balls of the invention may be used in a main game of bingo. However, a bingo, keno, lottery or similar type of game might be implemented as a bonus game or event to a main or other game or event. For example, a player might play a video slot game at an electronic gaming machine and upon receiving one or more game results, be awarded a bonus game or event using game balls in accordance with the invention. Such a bonus/secondary event or game might require an additional wager or might be played as part of the original wager for the game.

As indicated, in certain games, a player may be permitted to pick or select their numbers for the game. In a lottery game, a player might be permitted pick six (6) numbers. Normally, six (6) game balls are selected, each bearing a single number. Thus, a player attempts to match their six (6) numbers to the six (6) game numbers. In accordance with the invention, one or more of the game balls might bear two or more numbers, thus allowing the player to match seven (7) or more game numbers to their six (6) player numbers, substantially increasing the probability for matches.

In addition, in those instances in which a player has their numbers selected for them (known as a "quick-pick"), one or more game balls or selections might include two more indicia. In that event a player might have seven (7) or more player numbers picked for them. Again, when the game balls are selected, this results in an increased probability for the player or receiving matches.

In some embodiments, the game balls may be used to play more than one game, or participation or use of the second or additional indicia associated with a game ball may be based upon particular criteria. In one embodiment, the two or more indicia associated with a game ball might be distinguishable. For example, a first indicia might be designated as a primary indicia and might be printed in a large size or in a first color. A second indicia might be designated as a secondary indicia and might be printed in a smaller size (compared to the primary indicia—such as B1/O75) or in a second color.

In a bingo game, for example, a set of bingo balls might be marked with primary indicia B1-O75 and secondary indicia B1-O75, with each bingo ball bearing two game indicia—one primary indicia and one secondary indicia. In this embodiment, two bingo games might be played at the same time. A player might place a wager or buy a card to play the game using the primary indicia and might place a second wager or buy a second card to play another bingo game using the secondary indicia. If the player did not place both wagers/buy both cards, the player might not be permitted to play both games. A player might receive a bonus for playing and winning both games (such as a bonus award, progressive jackpot or the like).

As another example, a player might place a base wager to play a bingo game using the primary indicia. The player might be required to place an additional wager or "side bet" in order to utilize the secondary indicia. In this configuration, if a bingo ball were selected that had both a primary and secondary indicia marked on it, a player who only placed the base wager would only be permitted to try and match the primary indicia to their game card. However, a player who placed the additional wager would be permitted to try and match both of the primary and secondary indicia to their game card. This configuration has the benefit of enticing players to place additional or higher wagers in order to utilize the additional indicia (beyond a first indicia) associated with a game ball. In addition, the addition or higher wager might be used to fund jackpots or awards in view of the fact the additional indicia result in higher win probabilities for the game.

In one embodiment, a first or primary indicia may be marked on a game ball and second (or additional) indicia may be associated with the first indicia. For example, before a game, a ball marked B10 may automatically be associated with the secondary indicia O70, though the secondary indicia is not actually displayed on the game ball.

As indicated, sets of game balls may have various numbers of balls and the number of balls which bear two or more indicia may vary. Thus, all game balls might bear two or more indicia. In some instances, some of the indicia used in the play of a game may be borne on two or more of the game balls.

Of course, these principles may be applied to various games and may be applied in physical and electronic environments, as with the other principles of the game detailed above.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A set of game balls for use in playing a game utilizing a set of multiple game indicia, each indicia of said set of game indicia comprises a combination of a letter and a number, one or more of said game balls consisting of a single of said game indicia selected from said set of multiple game indicia and at least another one of said game balls consisting of at least two different game indicia selected from said set of multiple game indicia.

2. The set of game balls in accordance with claim 1 wherein said game balls comprise bingo balls.

3. The set of game balls in accordance with claim 1 wherein said at least one of said game balls bearing at least two different game indicia comprises a game ball bearing a first combination of a letter and a number and a second combination of a letter and a number, said first and second combinations differing from one another.

4. The set of game balls in accordance with claim 1 wherein each game indicia from said set of multiple game indicia is associated with at least one game ball.

5. The set of game balls in accordance with claim 1 wherein said game balls comprise spherical objects.

6. The set of game balls in accordance with claim 1 wherein said game balls comprise electronic images.

7. A set of game balls for use in playing a game utilizing a set of n different game indicia each indicia of said set of n different game indicia comprises a combination of a letter and a number, a number n−2 of said game balls each consisting of a single different one of said game indicia selected from said set of game indicia and a single of said game balls consisting of two different game indicia selected from said set of game indicia, whereby said set of game balls totals n−1 in number and each of said n different game indicia are represented a single time on said set of n−1 game balls.

8. The set of game balls in accordance with claim 7 wherein n=75 and said game indicia comprise the numbers 1 through 75 and wherein said set of game balls totals 74 in number.

9. The set of game balls in accordance with claim 7 wherein n=75 and said game indicia comprise the indicia B1 through B15, I16 through I30, N31 through N45, G46 through G60 and O61 through O75.

* * * * *